United States Patent [19]

Wright

[11] 3,995,456

[45] Dec. 7, 1976

[54] DEVICE FOR TRAPPING FRINGE YARNS IN A CIRCULAR KNITTING MACHINE

[75] Inventor: Dennis Wright, Leicester, England

[73] Assignee: Wildt Mellor Bromley Limited, England

[22] Filed: Jan. 26, 1976

[21] Appl. No.: 652,342

[30] Foreign Application Priority Data

Jan. 24, 1975 United Kingdom ..... 3122/75

[52] U.S. Cl. ..... 66/140 R

[51] Int. Cl.[2] ..... D04B 35/00

[58] Field of Search ..... 66/133, 134, 138, 140, 66/141, 142, 145

[56] References Cited

UNITED STATES PATENTS

| | | | |
|---|---|---|---|
| 2,173,788 | 9/1939 | McAdams | 66/145 R |
| 2,559,327 | 7/1951 | St. Pierre | 66/145 R |
| 2,691,285 | 10/1954 | Brown et al. | 66/140 R |
| 2,705,408 | 4/1955 | Mehnert | 66/145 R X |

*Primary Examiner*—Ronald Feldbaum
*Attorney, Agent, or Firm*—Irving M. Weiner; Pamela S. Austin

[57] ABSTRACT

A circular knitting machine is described in which two devices for temporarily trapping cut fringe yarns are mounted on the needle cylinder, respectively immediately following the last needle to knit and immediately preceding the first needle to knit. Each trapping device has a radially movable yarn gripping jaw urged into contact with a fixed jaw by resilient means. A cam-operated mechanism temporarily moves the movable jaw out of contact with the fixed jaw against the action of the resilient means in order to allow insertion of a fringe yarn between the jaws and release of a fringe yarn from the jaws.

10 Claims, 3 Drawing Figures

DEVICE FOR TRAPPING FRINGE YARNS IN A CIRCULAR KNITTING MACHINE

This invention relates to circular knitting machines in which a section of the needle cylinder and dial is a non-knit section i.e. a section which is free of needles or in which the needles do not knit, the yarn being cut after it has left the last needle to knit, thus leaving fringe yarns projecting from the edges of the knit piece. In particular, the invention relates to a device for temporarily trapping the fringe yarns to prevent them from being drawn into the knit piece during knitting of subsequent courses.

It is well-known for a circular knitting machine to have a non-knit section over which the yarn is floated, the machine having a yarn cutter which rotates with a yarn feeder and is capable of cutting the yarn at the edges of the non-knit section. The yarn feeder is capable of feeding two or more yarns so as to allow the production of stripes (approximately horizontal). The change of yarn takes place in the non-knit section, and it is usual for the second yarn to be inserted before the first yarn is cut, but with the increasing cost of yarn it is becoming more economic to save yarn by cutting the first yarn as it enters the non-knit section and inserting it again (or the second yarn) at the end of the non-knit section. Clearly, the non-knit section can be extended to vary the width of knitted fabric produced. The cut fringe yarns projecting from the edge of the descending knit piece tends to be drawn into the knitted fabric during knitting of subsequent courses, so it is usually necessary to provide a device for trapping the fringe yarns temporarily, following the last needle to knit and/or preceding the first needle to knit.

The present invention provides a device for temporarily trapping cut fringe yarns in a circular knitting machine, the device being mounted on the needle cylinder immediately following the last needle to knit or immediately preceding the first needle to knit and comprising a pair of yarn gripping jaws, one jaw being fixed, the other being radially movable and urged into contact with the fixed jaw by resilient means, and a cam-operated mechanism for temporarily moving the movable jaw out of contact with the fixed jaw against the action of the resilient means in order to allow insertion of a fringe yarn between the jaws and release of a fringe yarn from the jaws.

The invention will be described further, by way of example only, with reference to the accompanying drawings, in which.

Figure 1:
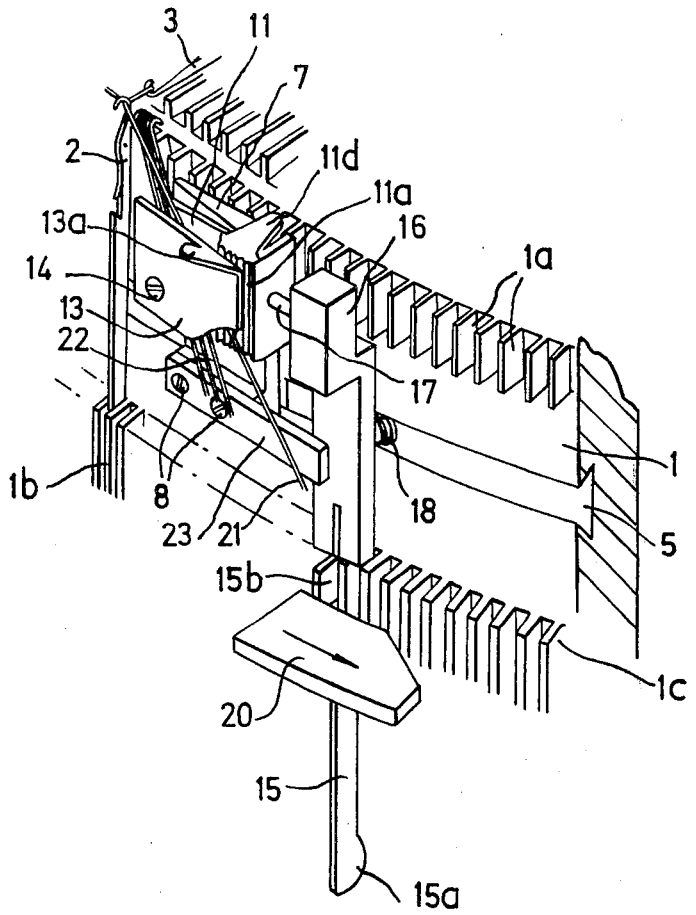
FIG. 1 is a perspective view of a fringe yarn trapping device mounted on the needle cylinder of a circular knitting machine.

The circular knitting machine partly illustrated in FIG. 1 has a stationary needle cylinder 1 with verge walls 1*a*, needle tricks 1*b*, and needles 2, only one of which is shown. Above and within the needle cylinder circle is situated a dial having similar verge walls and slots carrying dial needles 3, only one of which is shown. The needle cylinder tricks 1*b* terminate at a level 1*c* below the verge walls 1*a* and there is thus a smooth cylindrical zone between the needle tricks 1*b* and the verge walls 1*a*. The trapping device is located in this zone and is adjacent to the last needle to knit in an arc of needles (not shown). (An identical trapping device is located adjacent to the first needle to knit.)

Figure 2:
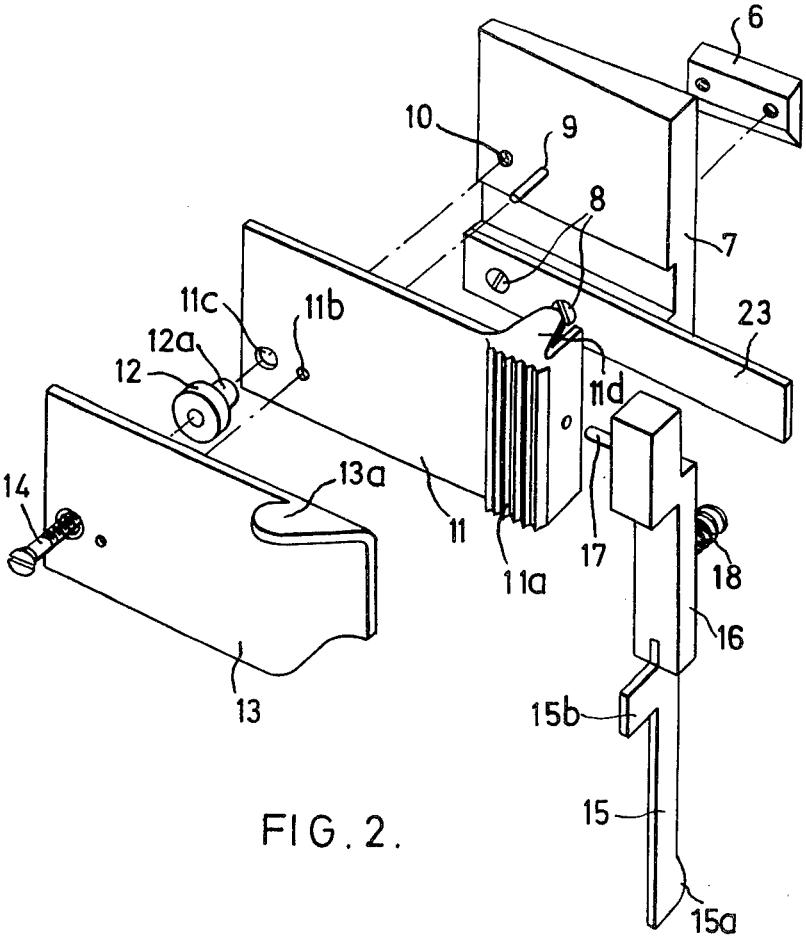
FIG. 2 is an exploded view of the trapping device of FIG. 1.

A tenon slot 5 is formed around the smooth cylindrical zone of the needle cylinder 1 and the trapping device is mounted on the cylinder 1 by means of this slot. The trapping device includes a tenon 6 (FIG. 2) which is fitted within the slot 5, the slot being widened at an appropriate locality (not shown) to allow insertion of the tenon 6. A support plate 7 is secured by the screws 8 to the tenon 6 thus locking the plate 7 to the needle cylinder 1 in a releasable manner allowing circumferential positioning of the trapping device.

The support plate 7 has a fixed guide post 9 and a threaded hole 10. An intermediate plate or jaw 11 having a raised, corrugated clamping zone 11*a* comprising vertical ridges is freely mounted on the post 9, which passes through a hole 11*b* in the jaw. A further hole 11*c* is provided in the jaw 11 to accommodate a reduced diameter shank 12*a* of a spacer 12. A front plate or jaw 13 is mounted on the post 9 and the assembly is secured together by a screw 14 which passes through the jaws 13 and 11 and the spacer 12 and is screwed into a hole 10 in plate 7, thus rendering the front jaw 13 rigid with the support plate 7.

Since the reduced diameter shank 12*a* of the spacer 12 is longer than the local thickness of jaw 11, the jaw 11 can move to and fro between the fixed plate 7 and jaw 13.

The mechanism for moving the clamping jaw 11 radially (along the post 9) comprises a blade-like element 15 (which is inserted in a needle trick as shown in FIG. 1) having an integral or rigid block 16 from which a rod 17 projects laterally. The rod 17 is located in the clamping jaw 11 and thus by oscillating the element 15 on its fulcrum 15*a*, the clamping zone 11*a* can be caused to move into and out of contact with the fixed jaw 13. A spring 18 is located in the tenon slot 5 and serves (via the block 16) to urge the clamping zone 11*a* into contact with the jaw 13. For opening the jaws, a butt 15*b* is provided on the element 15, which can be contacted by a cam 20 (FIG. 1) rotating with the yarn feeding unit, whereby the element 15 is rocked back into the needle trick thus further compressing the spring 18. To prevent the spring 18 forcing the element 15 out of its trick when the clamping zone 11*a* is pressed against the jaw 13, an arm 23 secured to the support plate 7 by the screws 8 projects in front of the element 15 and block 16 to limit movement of the block 16.

Figure 3:
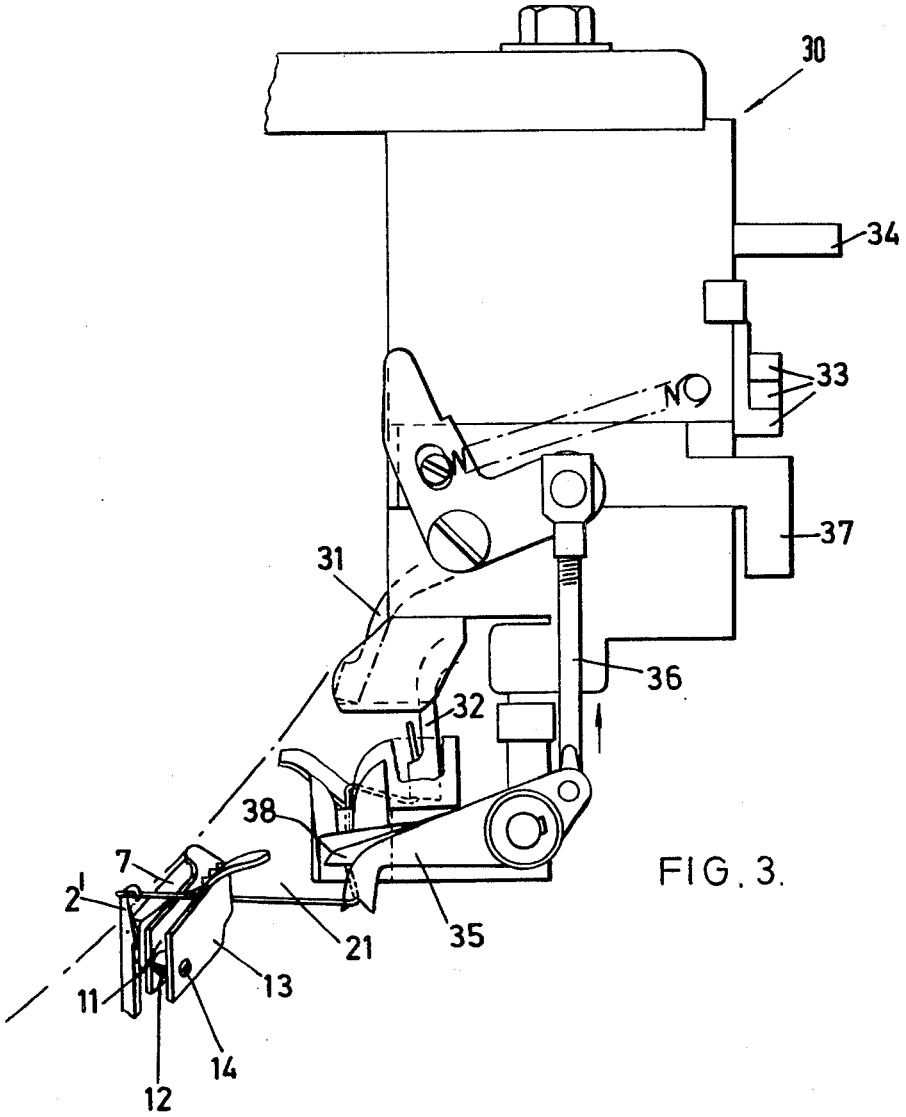
FIG. 3 shows part of the trapping device of FIGS. 1 and 2 in conjunction with a yarn feeding unit incorporating a cutter.

In FIG. 3 part of the trapping device is shown in conjunction with the last needle 2 to knit and a conventional yarn feeding unit. This unit has yarn feeders (only two of which, 31, 32 are shown) which can each be supplied with yarn, the feeder 31 being shown in the raised (operative) position, the feeder 32 being in the lowered (inoperative) position. The feeders are selected by stationary cams (not shown) cooperating with cam followers 33 on the rotating yarn feeding unit, and are withdrawn by slides 34 cooperating with fixed cams (not shown).

The yarn 21 coming from the last needle 2 is seen in FIGS. 1 and 3. The yarn 21 has been fed to the needles by the feeder 32 which, before passing the trapping device, was in the operative position. As the feeding unit passes the trapping device, the jaws 11,13 are opened by the cam 20. Subsequently, the yarn 21 is pushed down between the jaws 11,13 by a placer 35 actuated through a linkage 36 by a slide 37 operated by a stationary cam (not shown). (The placer also pushes the yarn 21 into a yieldable trapper on the feeding unit.) The yarn is guided by lips 11*d* and 13*a* on the respective jaws 11 and 13. A cutter 38 descends at the same time as the placer 35 and cuts the yarn 21 so as to leave a fringe yarn which is immediately afterwards gripped between the jaws 11,13 as the butt 15*b* (FIG. 1) is released by the cam 20. (The severed end of yarn from the feeder 32 is held by the yieldable trapper of the feeding unit.) Whenever the jaws 11,13 are out of contact, the preceding fringe yarns 22 are free to escape into the permanent recess between the jaws 11,13 (defined by the head of the spacer 12) from where they freely move up under the effect of the continuous downward and radially inward movement of the knitted fabric.

As mentioned above, a second trapping device (not shown) is located adjacent to the first needle to knit (to the right of the part of the knitting machine shown in FIG. 1). This trapping device is simply a mirror image of the trapping device described above. Before the yarn feeding unit (FIG. 3) reaches the first needle to knit, the feeder 32 is raised to the operative position so that the end of yarn extends between the feeder and the yieldable trapper of the feeding unit and automatically enters the jaws of the second trapping device.

Various modifications may be made within the scope of the invention. For instance, the clamping zone 11*a* on the jaws 11 may be replaced by or supplemented by a similar clamping zone on the jaw 13. The trapping device is also applicable to circular knitting machines in which the cylinder and dial rotate while the yarn feeding units are stationary. Furthermore, the yarn cutter need not be associated with the feeding unit but can be associated with the trapping device instead.

I claim:

1. In a circular knitting machine comprising a needle cylinder and a needle dial, the cylinder and dial having a non-knit section, yarn feeding means, and means for severing the yarn in the non-knit section, whereby a fringe of yarns is left along the edges of the knitted fabric, the improvement comprising a device for temporarily trapping fringe yarns, the device being mounted on the needle cylinder immediately following the last needle to knit and comprising a pair of yarn gripping jaws, one jaw being fixed, the other jaw being radially movable, resilient means for urging the movable jaw into contact with the fixed jaw, and a cam-operated mechanism for temporarily moving the movable jaw out of contact with the fixed jaw against the action of the resilient means in order to allow insertion of a fringe yarn between the jaws and release of a fringe yarn from the jaws.

2. A machine as claimed in claim 1, in which the fixed jaw is radially outside the movable jaw with respect to the needle cylinder.

3. A machine as claimed in claim 2, including a radially extending connector and a support to which the outer jaw is fixed by the connector.

4. A machine as claimed in claim 3, in which the movable jaw is capable of limited sliding movement along the connector.

5. A machine as claimed in claim 3, in which the support comprises a tenon mounted in a circumferentially extending slot in the needle cylinder.

6. A machine as claimed in claim 1, in which at least one jaw has a corrugated surface.

7. A machine as claimed in claim 1, in which the cam-operated mechanism comprises a cam-operated actuating member pivotally mounted on the needle cylinder and connected to the movable jaw, the resilient means acting between the actuating member and the needle cylinder.

8. A machine as claimed in claim 7, including a stop which limits the radially outward movement of the actuating member.

9. A machine as claimed in claim 1, further comprising a second device for temporarily trapping fringe yarns, the said second device being mounted on the needle cylinder immediately preceding the first needle to knit and comprising a pair of yarn gripping jaws, one jaw being fixed, the other jaw being radially movable, resilient means for urging the movable jaw into contact with the fixed jaw, and a cam-operated mechanism for temporarily moving the movable jaw out of contact with the fixed jaw against the action of the resilient means in order to allow insertion of a fringe yarn between the jaws and release of a fringe yarn from the jaws.

10. In a circular knitting machine comprising a needle cylinder and a needle dial, the cylinder and dial having a non-knit section, yarn feeding means, and means for severing the yarn in the non-knit section, whereby a fringe of yarns is left along the edges of the knitted fabric, the improvement comprising a device for temporarily trapping fringe yarns, the device being mounted on the needle cylinder immediately preceding the first needle to knit and comprising a pair of yarn gripping jaws, one jaw being fixed, the other jaw being radially movable, resilient means for urging the movable jaw into contact with the fixed jaw, and a cam-operated mechanism for temporarily moving the movable jaw out of contact with the fixed jaw against the action of the resilient means in order to allow insertion of a fringe yarn between the jaws and release of a fringe yarn from the jaws.

* * * * *